United States Patent [19]

Kontos

[11] 4,264,670

[45] Apr. 28, 1981

[54] NON-WOVEN FABRIC MADE FROM POLYBUTADIENE

[75] Inventor: Emmanuel G. Kontos, Trumbull, Conn.

[73] Assignee: Uniroyal, Inc., New York, N.Y.

[21] Appl. No.: 96,609

[22] Filed: Nov. 21, 1979

[51] Int. Cl.[3] ..... B32B 25/16; D04H 1/04

[52] U.S. Cl. ..... 428/224; 128/284; 128/290 W; 264/DIG. 8; 428/296; 428/315; 428/424.8

[58] Field of Search ..... 428/224, 296; 526/335; 264/DIG. 8

[56] References Cited

U.S. PATENT DOCUMENTS

| | | | |
|---|---|---|---|
| 3,431,875 | 3/1969 | Boultinghouse | 28/162 |
| 3,542,632 | 11/1970 | Eickhoff | 28/162 |
| 3,950,582 | 4/1976 | Keuchel | 428/95 |
| 4,085,175 | 4/1978 | Keuchel | 264/DIG. 8 |

OTHER PUBLICATIONS

C.A. 92–77856.
C.A. 92–77830.
C.A. 89–111787.
C.A. 87–24102.

*Primary Examiner*—James C. Cannon
*Attorney, Agent, or Firm*—Thomas A. Beck

[57] ABSTRACT

A non-woven fabric comprising an assembly of fibers of discrete length which are interconnected and, at least a portion of which are in contact with each other, said fibers comprising crystalline syndiotactic 1,2-polybutadiene (1,2 SBD).

1 Claim, No Drawings

NON-WOVEN FABRIC MADE FROM POLYBUTADIENE

The present invention relates to a non-woven fabric comprising an assembly of fibers of discrete length which are interconnected and, at least a portion of which are in contact with other, said fibers comprising crystalline syndiotactic 1,2-polybutadiene (1,2 SBD).

Presently non-woven fabrics are used for a variety of applications such as for covers for disposable diapers and other hygienic applications, decorative scrims, fusible scrims for adhesive applications, industrial fabrics such as backing fabrics for carpet manufacturing, as a packaging fabric and as an insulating fabric, etc. Presently polypropylene and other thermoplastic polymers used for these applications by extruding and fibrillating the film into a fibrous interconnected network. However, the polypropylene products made using the aforesaid process do not have good elongation and elasticity, and as a result the fabric has a low tensile strength and in particular a low tear strength. Other thermoplastic polymers have similar disadvantages and/or limitations in respect to skin irritation, moisture resistance, high melting point, air permeability, etc.

In accordance with the present invention a non-woven fabric made up of 1,2 SBD can be utilized for all of the applications noted above. A unique advantage of the present invention is the low modulus, high elongation and good recovery of the 1,2 SBD fibers, resulting in a non-woven fabric having high strength properties. Other advantages in using 1,2 SBD in a non-woven fabric are the aesthetic appearance of the 1,2 SBD due to its light transparence, its non-toxic and non-skin irritating properties, its low melting point when used in adhesive applications, its good pliability thus facilitating its use in complicated configurations and its good moisture resistance and air permeation when used in disposable diapers and hygienic napkin applications.

The low melting point of 1,2 SBD make it useful in fiber form for adhesive applications since the polar nature of 1,2 SBD promotes good interaction with the adhering substrates. It is felt that because of the greater number of vinyl unsaturated groups in the polymer as compared with cis-polybutadiene or SBS block copolymers, a higher adhesive bond is developed through the use of 1,2 SBD fibers.

The 1,2 SBD used in the non-woven fabric and in accordance with the present invention is a polymer possessing a vinyl group and a hydrogen atom each bonded to a tertiary carbon atom at the allyl position in each structural unit. Table I hereinafter lists the range of physical properties of the 1,2 SBD fibers useful in accordance with the present invention.

TABLE I

| PROPERTIES | TEST METHOD | UNITS | RANGE |
|---|---|---|---|
| DENSITY | Density gradient tube ASTM D-1505 | $g/cm^3$ | 0.901 to 0.909 |
| MOLECULAR WEIGHT | Gel Permeation Chromatography | | 100M |
| CRYSTALLINITY | Density gradient tube | % | 18 to 29 |
| MICRO-STRUCTURE 1,2-Unit Content | Infrared ray Spectrum (Morero method) | % | 90 to 93 |
| MFI (Melt Flow Index) | ASTM D-1238 | | |

TABLE I-continued

| PROPERTIES | TEST METHOD | UNITS | RANGE |
|---|---|---|---|
| 150° C. 2,160 g | | g/10 min | 3 to 2 |
| THERMAL PROPERTIES | | | |
| Vicat softening point | ASTM D-1525 | °C. | 39 to 66 |
| Melting Point - $T_m$ | (DSC) | °C. | 75 to 90 |
| Tg °C. | (DSC) | °C. | −30 to −17 |
| Brittle Point | ASTM D-1790 | °C. | −40 to −35 |
| TENSILE PROPERTIES (3) | | | |
| 300% Modulus | ASTM D-882 | psi<br>MPa | 570 to 1100<br>3.9 to 7.8 |
| Tensile Strength | ASTM D-882 | psi<br>MPa | 925 to 1900<br>6.4 to 13.2 |
| Elongation | ASTM D-882 | % | 750 to 670 |
| HARDNESS Shore D | ASTM D-1706 | | 25 to 41 |
| IZOD IMPACT (notched, at (R.T.) | ASTM D-256 | kg-cm/cm | Not broken |
| LIGHT TRANSMITTANCE | ASTM D-1003 | % | N 91 |
| HAZE | ASTM D-1003 | % | 1.0 to 2.0 |

The 1,2 SBD fibers used in the present invention are prepared in accordance with the disclosure found in U.S. Pat. Nos. 3,431,875; 3,542,632; 3,950,582; 4,085,175.

The fabric can be prepared by a variety of well known methods. One method of preparation involves initially spinning the filaments, chopping or cutting the filaments into discrete fibers, carding to form a continuous web and bonding the fibers. The bonding can be acheived by pressure and heat, by mechanical entanglement, by adhesive bonding or by other known processes used to produce non-woven fabrics and papers.

For the purpose of this invention, the term "discrete" is used to describe the length of the fiber as contrasted with the almost infinite length of fibers used in woven applications.

Another method of preparation is the extrusion of the polymeric material followed by a fibrillation technique. The economic advantage of this method over the one mentioned above is the direct conversion from a polymer melt to a textile product which is a non-woven fabric, without the need for a spinning step.

A further useful method of preparation is the melt casting of the polymeric 1,2 SBD material into unoriented film which is uniaxially oriented in a hot-stretching zone and mechanically worked to produce the fibrillated product.

A more recent method for producing non-woven fibrous networks comprises extruding a mixture of a molten polymeric material and a foaming agent radially through a circular die, then applying stress with a substantial radial component to said molten polymeric material to attenuate the extrudate and produce and attenuated network upon extrusion from the die.

The extrudate is quenched to a temperature below its melting point, and then stretched further in a direction with a substantial radial component to form the non-woven fibrous network.

The following example is illustrative of the invention.

Crystalline syndiotactic 1,2-polybutadiene pellets having a melt index of 3 were dry blended with 1 percent by weight of azodicarbonamide blowing agent. The blended polymer was fed into the hopper of a 3-inch diameter extruder, and passed through a radial die having a diameter of 13 inches. Starting from the die, which was maintained at 152° C. (305° F.), the temperature zones of the extruder were controlled at 155°-140°-135°-115° C.

The extruded melt was cooled at a controlled rate to below the melting temperature, 80° C. (176° F.) using two opposing air rings. The temperature of the air was adjusted at about 24° C. (75° F.). The extrudate was then contacted against the surface of an electrically heated ring to heat the fibrous extrudate to a temperature of 88° to 99° C. (190° to 210° F.). The extrudate was then forced over the outside of a ring, which was maintained at 7° C. (45° F.).

In passing over the cool ring, the cylindrical 1,2-SBD extrudate is biaxially oriented to an expansion ratio of about 2:1 and the crystalline structure therefore oriented to a substantial degree.

The biaxially oriented extrudate was then collapsed by an internal spreading guide to produce a double layer, flat fabric structure which was pulled by a pair of nip rolls.

The fabric obtained was very fibrous, its weight was 0.3 oz/yd$^2$ and it had a strength ratio of 5 to 1 (strip tensile machine direction/strip tensile transverse direction).

A quantity of this fabric was used successfully as a cover for disposable diapers. Another portion of this fabric was used as a fusible scrim for the adhesion of polyurethane foam to synthetic cover upholstery fabrics.

What I claim and desire to cover by Letters Patent is:

1. A non-woven fabric comprising an assembly of fibers of discrete length which are interconnected and, at least a portion of which are in contact with other, said fibers comprising crystalline syndiotactic 1,2-polybutadiene.

* * * * *